US009611671B2

(12) United States Patent
Tyrrell et al.

(10) Patent No.: US 9,611,671 B2
(45) Date of Patent: Apr. 4, 2017

(54) SECURITY DEVICE AND SYSTEM

(75) Inventors: Karen Tyrrell, Hamilton (NZ); Craig David Malins, Hamilton (NZ); Richmond Balcombe Spencer, Hamilton (NZ)

(73) Assignee: Gallagher Group Limited, Hamilton (NZ)

( * ) Notice: Subject to any disclaimer, the term of this patent is extended or adjusted under 35 U.S.C. 154(b) by 1184 days.

(21) Appl. No.: 13/499,544

(22) PCT Filed: Oct. 4, 2010

(86) PCT No.: PCT/NZ2010/000195

§ 371 (c)(1),
(2), (4) Date: Aug. 13, 2012

(87) PCT Pub. No.: WO2011/040826

PCT Pub. Date: Apr. 7, 2011

(65) Prior Publication Data

US 2012/0298942 A1 Nov. 29, 2012

(30) Foreign Application Priority Data

Oct. 2, 2009 (NZ) ..... 580207

(51) Int. Cl.
*E04H 17/26* (2006.01)
*A01K 3/00* (2006.01)

(52) U.S. Cl.
CPC ..... *E04H 17/266* (2013.01); *A01K 3/00* (2013.01); *A01K 3/005* (2013.01); *Y10T 29/49117* (2015.01)

(58) Field of Classification Search
CPC ..... A01K 3/00; A01K 3/005; E04H 17/02; E04H 17/08; E04H 17/12; E04H 17/266; F16G 11/00; H01B 17/145
See application file for complete search history.

(56) References Cited

U.S. PATENT DOCUMENTS 4,171,796 A * 10/1979 Forbush ..... 242/388.3
4,700,434 A * 10/1987 Fambrough ..... 242/388.2
5,170,536 A 12/1992 McBroom
5,412,158 A 5/1995 Yearwood
(Continued)

FOREIGN PATENT DOCUMENTS

CA 1097323 3/1981
GB 767795 A 2/1957
(Continued)

OTHER PUBLICATIONS

International Search Report for corresponding PCT Application No. PCT/NZ2010/000195, mailed Dec. 24, 2010, 4 pages.

*Primary Examiner* — Daniel Wiley
(74) *Attorney, Agent, or Firm* — Fish & Richardson P.C.

(57) ABSTRACT

A strainer for straining a length of material, the strainer including a tensioning device configured to tension a length of material between the strainer and an object, characterized in that the strainer includes a conductive component configured to contact the length of the material when held by the tensioning device, and wherein the conductive component includes an attachment portion for an external conductive link to the strainer. This invention also relates to a security system and its method of preparation using the strainer as described herein.

16 Claims, 8 Drawing Sheets

(56) References Cited

U.S. PATENT DOCUMENTS

| | | | | |
|---|---|---|---|---|
| 5,738,341 | A | 4/1998 | Lease | |
| 2002/0093011 | A1* | 7/2002 | Crichton | F16G 11/12 256/40 |
| 2003/0094602 | A1* | 5/2003 | House et al. | 256/40 |
| 2005/0161657 | A1* | 7/2005 | Dennis | 256/40 |

FOREIGN PATENT DOCUMENTS

| | | | | |
|---|---|---|---|---|
| GB | 1513327 | | 6/1978 | |
| GB | 2143876 | A * | 2/1985 | A01K 3/00 |

* cited by examiner

SECURITY DEVICE AND SYSTEM

TECHNICAL FIELD

This invention relates to a security device and its method of use.

BACKGROUND ART

This invention will be discussed in relation to improvements in strainers used with wire in an electric security fence. However, a skilled person will appreciate that the principles of the present invention can be applied to tensioning lengths of other materials in different situations and is not necessarily limited to electric fences and/or wire.

Strainers have been in use for numerous years to aid the tensioning of wire in fences, such as those used in the farming or security industries. The fences can be either conventional or electrified.

Most current fence strainers utilise a ratchet pivotally attached to a strainer. The ratchet typically has a set of teeth around the circumference of the ratchet that interacts with a locking mechanism such as a pawl which is also attached to the main body of the strainer. The interaction between the teeth and the pawl allows the ratchet to be turned in one direction when tightening the wire, but not in the other direction. The pawl is usually engaged with the teeth of the ratchet due to gravity (or a spring) and held in place by the tension of the fencing wire once strained up and under tension.

Most security fences rely on a system where multiple wires are tensioned in parallel using strainers currently available in the art. Typically, the electrical current is passed from one wire to another wire using two clamps or crimps and a wire link (herein termed a conductive link). The conductive link is usually positioned near to the ratchet along the length of the adjacent wires. This results in an electric current passing through the adjacent fence wires to discourage people/animals from contacting the fence in fear of being shocked or electrocuted. Also, if a wire is cut or shorted out to an adjacent wire then monitoring electronics circuits can send a signal to a control system or sound an alarm indicating a security breach. However, these systems above have a number of disadvantages as discussed below.

Installation of the conductive links and strainers requires considerable time, skill and effort to provide the desired outcome. This dramatically affects the overall cost (due to man hours) in fence preparation, maintenance and replacement.

Furthermore, as the conductive link and strainer are separate units, the system described above can be untidy and unappealing to the onlooker. This can be an issue for property holders that require security fences, yet want to maintain an aesthetic appearance to their fence and property.

Wires in fences are prone to loosening over time (due to stretching), and the strainers are often periodically used to re-tension the wires; usually rotation of the ratchet will achieve this result.

However, the conductive links located between the wires can become uneven due to wire adjustment which can add to the untidiness of the fence. Fixing this unappealing feature requires further time, and ultimately cost.

Furthermore, as the conductive links are typically inflexible, the conductive links only have a certain amount of movement which will ultimately hinder the amount of possible adjustment of the wires. Again, re-adjustment of the conductive links to address this problem can take further time and effort.

Currently available systems can also present a risk that a perpetrator can cut the security wire upstream of the conductive link's position to avoid triggering an alarm. All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided a strainer for straining a length of material, the strainer including a tensioning device configured to tension a length of material between the strainer and an object, characterised in that the strainer includes a conductive component configured to contact the length of the material when held by the tensioning device, and wherein the conductive component includes an attachment portion for an external conductive link to the strainer.

According to a second aspect of the present invention there is provided a security system including at least two strainers as described above, wherein a length of material is attached to the tensioning device of at least one strainer and in contact with the conductive component in the strainer, characterised in that at least one strainer is also connected to at least one other strainer via an external conductive link which is in contact with the attachment portions of the conductive component on each strainer.

According to another aspect of the present invention there is provided a security system including at least one strainer as described above, wherein a length of material is attached to the tensioning device of at least one strainer and in contact with the conductive component in the strainer, characterised in that the strainer is also connected to an electric fence energiser via a length, of material which is in contact with the attachment portion of the conductive component of the strainer.

The contact may be via a lug which is able to support the electrical connection of the length of material to the conductive component (e.g. wire)

According to another aspect of the present invention there is provided a method of constructing a security system as described above, the method including the steps of:

a) attaching a portion of a length of material to the tensioning device of a first strainer wherein the length of material contacts a portion of the conductive component on the first strainer;
b) attaching a different portion of the length of material to the tensioning device of a second strainer wherein the length of material is positioned to be able to contact a portion of the conductive component on the second strainer;
c) attaching an conductive link from the first and/or second strainer to at least one additional strainer, wherein the conductive link is positioned to contact with the attachment portion of the conductive component on each strainer to be connected;
d) applying an electrical current to the security system to allow electric current to travel from one strainer to another strainer through the conductive component and conductive link.

SUMMARY OF ADVANTAGES OF THE CURRENT INVENTION

Some significant advantages of the present invention are discussed below.

A major advantage of the present invention is that the shorter set up time significantly reduces overall cost in installation, and also maintenance. This is because the conductive link and length of material (e.g. wire) may be positioned and strained, respectively, in the same operation due the interaction between the tensioning device and the conductive component in the strainer.

With prior art systems, it can be necessary to spend considerable time in first straining the wire to a desired level, and then having to carry out the second task of positioning and fixing the conductive link at a different location to the strainer. A result of the new strainer is that set-up, repair and maintenance of the wire tensioning and the electrical connection can be performed as one step.

Because of the unique interaction between the conductive component and tensioning device in the present invention, the tension of the wire may be adjusted without substantial risk of affecting the electrical connection between two or more wires. In previous systems, readjustment of the electrical connection was often necessary after re-tensioning of wires, making such systems cumbersome and generally inconvenient.

It has been estimated that up to 75% of the installation costs of the systems (e.g. security fencing) are attributable to the technical process described above. The costs involved can be readily appreciated when considering that security fencing systems can often be installed over great distances of terrain (for example up to 100s of kilometers in length—e.g. border control). The present invention may help to significantly reduce the overall installation costs and maintenance, and ultimately have a dramatic effect on costs to a user implementing the strainer in security fence systems, and the like.

In currently available electric security fences, the insulative strainers are not used to transfer electric current from one strainer to another. Instead, a conductive link is separately positioned upstream of the strainer to transfer the current from one wire to an adjacent wire. In the current invention, the strainer is configured to allow passage of electric current using the integration of the conductive component and link between strainers while still allowing the body of the strainer to be made from an insulative material.

This provides a number of advantageous results.

For example, it may help to avoid a perpetrator from breaching the security fence, especially without triggering an alarm. Previously, a perpetrator could cut the security wire upstream of the conductive link's position to avoid triggering an alarm. Movement of the conductive link to a peripheral position within the strainer may make it very difficult for this to occur.

Further advantages of the invention are discussed throughout the remainder of the specification.

Preferred Embodiments of the Strainer

Throughout the specification, the term strainer should be taken as meaning any apparatus used for adjusting the tension of a length of material. Substantially any form of strainer may be used with the present invention. As such, alternatives or modifications not specifically discussed in this specification should not be considered beyond the scope of the invention.

A strainer which the Applicant considers appropriate for the present invention is discussed below to provide context. The tensioning device of the strainer may be retained within a housing.

The housing may include a backing portion which is configured to be attached to a fixed object, such as a wall or fence post. The housing may also include a head portion, which preferably retains the tensioning device.

The backing portion of the housing may be a box shape. Such a shape may allow sufficient surface area to fasten the backing portion to a support. For example, the backing portion may be fastened to a wall or post by cementing, gluing, or bolting the backing portion into a space in the support configured to the shape of the backing portion.

The backing portion may be configured to receive a hook which then attaches to the post to allow the strainer and hence the fence line to pivot relative to the surface of the post. Alternatively, the backing portion may be configured to "clip-on" to an object to allow a fast method of attachment.

The head portion may be shaped as two thin "curved arrow heads" spaced apart and substantially parallel to one another. Each of the two head portions may include an axis point to allow the tensioning device to be rotated and retained upon an axle located therein.

Preferably, the tensioning device and housing of the strainer are made from non-conductive material, such as plastic. An advantage of having a substantially non-conductive strainer is that the strainer may be connected to a post to provide isolation (or electrical insulation) from the electrified length of material (wire) and the post.

However, in some embodiments it may be advantageous that the tensioning device itself (which may be a spool or cog) is made of a conductive material.

Preferably, the tensioning device is a ratchet. Throughout this specification, the term ratchet should be taken as meaning a mechanical device that allows movement in only one direction, and can be used as a bearing surface to tension a length of material.

Many types of ratchets are available in the art. Often, they are cylindrical in shape and have an outer surface with teeth, wherein the teeth may be substantially any configuration.

The teeth allow the ratchet to grip to a locking mechanism such as a pawl, which may allow the movement of the ratchet in only one direction.

Typically, an axle extends through the central region of the ratchet to allow rotational movement on a fixed member such as the housing, as described above. For example in the present invention, the ratchet may rotate on an axle provided in the head portion of the strainer. Similarly, the locking mechanism may be attached to the strainer using an axle. By correct positioning of the ratchet and locking mechanism within the strainer, engagement of the two may be made to provide the locking ability in one direction but movement in the opposite direction.

However, the inventors have surprisingly discovered that symmetrical shape of the teeth on the ratchet is particularly advantageous for the current invention. This feature is discussed further below.

The strainer of the current invention has at least two functions (to strain a length of material as well as providing an electrical connection for the conductive link). As a result of this added functionality, the strainer may typically be positioned in two main orientations when used in a security system, such as an electric fence.

This results in the ratchet having to be rotated in opposing directions depending on its orientation in order to strain a length of material. If the teeth are symmetrical, it may allow the locking mechanism to lock the ratchet's movement in either direction, and also allow movement in either direction. This feature may be achieved by ensuring the locking mechanism is configured to rotate to allow the locking mechanism to contact the teeth of the ratchet and bear against the surface of the tooth in leading in the direction of the force of rotation applied by the wire under tension. In this embodiment, the leading edges located on the tip of the locking mechanism may be symmetrically configured to engage with the corresponding shape of the teeth.

This is opposed to previous strainers, where ratchet teeth are typically asymmetrical (e.g. shaped like shark fins) in order to allow more effective movement in one direction but not the other. This was all that was required as the strainers had only one function (to strain a length of material). However, it meant that prior art strainers had to be orientated in a very specific way to ensure the direction of movement was correct. The present invention does not require such care in orientation as the ratchet can move in both directions.

However, other forms of ratchets may also be used in the present invention, such as those which move in a linear fashion to provide tension to a length of material. These forms of ratchets are well known in the art.

The tensioning device may have a central portion. For example, the central portion may connect two parallel circular shaped "cogs" which harbour teeth for the pawl to engage.

Preferably, the central portion of the tensioning device is hollow.

Most preferably, the hollow central portion of the tensioning device is accessible from one or both sides of the tensioning device.

Advantages for these features will become apparent in the ensuing description.

Preferably, the tensioning device includes an engagement portion configured to, in use, attach or engage the length of material.

Throughout the specification, the term length of material should be taken as meaning any elongated material typically used in forming partitions, usually conductive material such as steel wire, aluminium or alloy wire. However, the above examples should not be seen as limiting as the length of material may alternatively be nylon, canvas, rope, chain, and the like. For example, the length of a material may be a conductive link which connects the strainer to an electric fence energiser.

Preferably, the length of material is a wire. For ease of reference, the length of material shall now be referred to as wire, although it is envisaged that the invention may apply to other lengths of material such as those specified above.

Throughout the specification, the term engagement portion should be taken as meaning any device or configuration in the tensioning device that is capable of securing, either temporarily or permanently, a length of material to the strainer.

Preferably, the engagement portion is an aperture through the central portion of the tensioning device.

Preferably the aperture is positioned across the longitudinal axis of the hollow central portion of the restraining device.

An advantage of this feature is that a length of material (e.g. wire) may be introduced into the aperture, and upon rotational movement of the tensioning component, the wire may be tensioned effectively due to its shortened length as its length is wrapped around the central portion of the tensioning device.

If the central portion of the tensioning device is hollow, the aperture may be present on one wall or opposing walls of the central portion.

Conductive Component

The strainer includes a conductive component.

Throughout the specification, the term conductive component should be taken as meaning any object which is capable of conducting electricity.

For example, the conductive component may be made of metal such as galvanised steel or low copper content cast aluminium (LM6) or zinc casting. Both of these metals are advantageous as they may resist corrosion (rusting) long term in harsh environments (e.g. near salt water), and may resist galvanic corrosion (different types of metals in contact with each other can cause corrosion to happen more rapidly).

Preferably, the conductive component is configured to slidably fit within the hollow central portion in the central portion of the tensioning device. In some embodiments, the conductive component may be in the form of a slug.

For example, a portion of the conductive component may be shaped as a six sided elongate cylinder and the hollow central portion of the tensioning device may have correspondingly shaped outer walls.

This may allow a slidable fit between the conductive component and the hollow central portion of the tensioning device. However, it should be acknowledged that the conductive component and hollow central portion of the tensioning device may be any shape that allows a drive function (i.e. wherein the movement of either one of the conductive component or tensioning device is replicated by the other hollow central portion The inventors acknowledge that a slidable fit may be accomplished through many ways which should not be considered beyond the scope of the invention.

The inventors consider that a slidable fit may result in unwanted slippage of the conductive component within the hollow central portion.

As such, the inventors consider that the internal surface of the hollow central portion may include a protrusion. In this embodiment, the conductive component may include a notch or recess configured to engage with the protrusion on the hollow central portion at a pre-determined position. For instance, the pre-determined position may be such that the apertures on both the conductive component and tensioning device align correctly.

Vice versa, the hollow central portion may include a notch or recess, and the conductive component may include a corresponding protrusion.

Also, it is not necessary for the conductive component to be housed internally within the tensioning device, although this is preferred by the inventors.

The conductive component may have an engagement portion substantially similar to the corresponding engagement portion located on the tensioning device.

Preferably, the engagement portion in the conductive component is an aperture that passes entirely through the conductive component.

Preferably, the aperture is positioned on the conductive component such that, when the conductive component is correctly positioned in the hollow central portion of the central portion, the aperture in the conductive component aligns substantially with the aperture in the tensioning device (which is preferably on its central portion).

The conductive component may be configured to have a first end and a second end.

The aperture in the conductive component may be positioned on the first end.

The conductive component may be configured to only fit into the hollow central portion of the tensioning device when the apertures in the tensioning device and conductive component are correctly aligned.

Preferably, the conductive component has at least one recess that extends along a longitudinal length of the conductive component. The purpose of this feature is to engage with a corresponding protrusion on the internal surface of the hollow central portion of the tensioning device. When the conductive component engages with the hollow central portion, the recess and corresponding protrusion may allow correct alignment of the apertures in the conductive component and tensioning device.

Also, the recess and corresponding protrusion may form a block to prevent the conductive component from moving past a certain position within the hollow central portion. This may be advantageous to prevent shearing of the length of material (e.g. wire) passing through the apertures of the conductive component and tensioning device when tension is applied to the conductive component. It may also help to ensure contact with the wire is in compression. The advantages of this feature will become more apparent in the ensuing description.

Alternatively, the conductive component has at least one protrusion extending from the first end of the conductive component. Subsequently, corresponding deviations in the hollow central portion of the tensioning device may allow the protrusions and deviations to engage to provide the same functionality as that described above A person skilled in the art would appreciate that alternative configurations of the conductive component may also be used, depending on the circumstance and the configuration of the corresponding hollow central portion within the tensioning device.

Preferably, the second end of the conductive component has a threaded portion.

The second end of the conductive component is configured to protrude out from the tensioning device. This configuration provides the attachment portion on the conductive component which enables access for the conductive link.

If the tensioning device is provided in a housing, the second end also preferably protrudes from the housing to provide the attachment portion. This may allow an appropriate fastener (e.g. nut) to be applied to the second end of the conductive component to be tightened against the housing and in turn, the tensioning device. The inventors consider that an appropriate fastener to be used may be a nut having an internal flange (external or internal lip or rim) which may contact with the raised lip on the linking points of the conductive link (discussed further in the specification).

Additionally, the second end of the conductive component may include a gripping portion located peripheral to the threaded portion. For example, the gripping portion may be a hexagonally shaped drive ("Hex-drive") configured to allow easier gripping. The hex-drive may allow easier rotation of the tensioning device for tensioning. Also, it may be used to hold the conductive device stationary while the fastener (e.g. nut) is loosened or tightened.

Subsequently, loosening of the fastener may allow the tensioning device to be rotated via the conductive component due to the corresponding shape (in a preferred embodiment, hexagonal) between the tensioning device and the conductive component.

Also of the Hex-drive located peripheral to the threaded end on the conductive component may allow easier rotation of the conductive component. For example, the Hex-drive may allow the wire to be tensioned without disturbing the position of the conductive link.

The Hex-drive on the conductive component also may allow the conductive component to be held against rotation while the fastener is tightened or loosened to secure or release the conductive link and also the electrical connection between the conductive component and the wire.

When a length of material (e.g. wire) is inserted into the apertures of the conductive component and tensioning device, this may provide sufficient resistance to allow the fastener to tension the conductive device. Alternatively, the protrusions at the first end of the conductive device may provide resistance to allow the fastener to tightly fasten the second end of the conductive device.

The result may be that the conductive device is forced towards one side of the tensioning device thereby ensuring the contact of the conductive component with the length of material (wire).

This result may then allow for electrical current to travel from the length of material to the conductive device. In turn, the electrical current may travel from the conductive device to a further location due to the attachment portion of the conductive component (at the second end) wherein an external conductive link can be attached.

The inventors acknowledge that the conductive component may be permanently retained in the hollow central portion of the central portion, or may be removable. For example, a removable conductive component may allow for easier maintenance or repair if needed.

Security System

The strainer may be used in a security system with at least two strainers connected by a length of material such as electric wire.

The security system may include approximately many strainers aligned vertically, in opposition to a corresponding number of vertically aligned strainers, for instance attached to posts or walls. The number of strainers used may depend on the level of security required (e.g. distance between adjacent wires) and height of the security system. For example, the inventors envision using 66 strainers for a 4 meter high fence with wires spaced at 60 millimeters.

The inventors envision that anti-climb wires may be attached to the top few strainers in the vertical arrangement on a post. For instance, the anti-climb wires may be configured to surround the upper most portion of the post to prevent intruders from attempting to climb the post.

The anti-climb wires may be electrified. For example, this may be accomplished by ensuring that a portion of the anti-climb wire is in contact with the conductive component of the strainer. Alternatively, the anti-climb wire may be in contact with the conductive link, which in turn may be in contact with the conductive component.

The security system includes at least one conductive link.

Preferably, the conductive link is configured as an elongate arm with one offset attachment point at both ends. The conductive link is made substantially of a conductive material (e.g. metal).

The conductive link may be any length, depending on the distance between strainers to be linked. For example, if the user wants two adjacent wires in a security system separated by 15 cm, the entire length of the conductive link may be 15 cm.

The linking points on the conductive link may be in the shape of a washer.

The inventors consider that the washer-shaped linking points may have a raised lip a small distance from the internal edge of the aperture formed by the washer shaped linking points. This feature may help to provide a good engagement between the conductive link and a surface to which the raised lip of the conductive link engages (for instance, the fastener or strainer). This raised lip may also be advantageous for providing improved electrical contact. Preferably, the linking points of the conductive link are configured to fit on to the second end of the conductive component which protrudes from the tensioning device.

The inventors consider it may be advantageous to position a washer on the second end of the conductive component. When in position, the washer may reside next to the strainer (typically the housing of the strainer) such that when the conductive link, and fastener are subsequently fitted on to the second end over the washer, it may ensure a closer engagement of the components.

The washer may have a protrusion or tab that is configured to engage with a corresponding aperture in the housing of the strainer. This may help to lock the washer in place and ensure the washer maintains its correct position relative to the strainer.

The washer may be made of conductive material. This feature may be advantageous, particularly in the embodiment wherein an anti-climb wire, custom link, or a lead out wire to or from an electric fence energiser is to be attached to the conductive link. A portion of the anti-climb wire may be positioned between the washer and conductive link on the second end of the conductive component. This may help to ensure electrical connection between the conductive link and the anti-climb wire.

The inventors consider that a lead-out wire may be connected to a strainer in the security system such that electrical connection may be made to any one or combination of: the fastener, the conductive link and washer and the conductive component. This may allow the security system to be electrified such that electric current may be passed from one strainer to another through the conductive link.

Similarly an energiser may be linked or connected to the strainer in a similar fashion as a source of electricity for the fence.

Therefore, electrical connection from the length of material to the conductive component, and subsequently to the conductive link may be made by tightening the fastener to the attachment portion of the conductive component, thereby sandwiching the conductive link. If the other attachment point of the conductive link is similarly attached to a second strainer, electrical connection between the two strainers may be provided through the conductive link.

Tightening of the fastener against the tensioning device has numerous advantages. It helps to ensure contact between the wire and conductive component, and subsequently contact between the conductive component and the conductive link. The conductive component may then allow the electrical current to continue through the wire and travel to the conductive component and then the conductive link to a further strainer to which the conductive link is attached.

Furthermore, tightening the fastener against the tensioning device (when the conductive component is in place) may help to secure the wire to the tensioning device to help avoid the wire slipping out of the strainer. This may be especially useful if the wire is not sufficiently wrapped around central portion of the tensioning device or the tension to the wire is loose.

As previously discussed, this is a significant advantage over systems currently available. For example, previous systems which have separate tensioning devices to the conductive connection between wires. This would require the conductive link to be adjusted following any tensioning of the wire. This step may be avoided as a result of the current invention, in turn dramatically saving time, effort and money in preparing, maintaining and fixing security systems.

Method of Preparing the Security System

A preferred method of preparing and using the strainer in a security system is discussed below.

This method may include inserting the conductive component into a hollow central portion in a central portion of the tensioning device prior to step a). This embodiment may be appropriate if the conductive component is removable.

Preferably, the method includes applying a wire into an aperture in the tensioning device. The tensioning device may then be used to loosen the slack of the wire and tension the wire to the appropriate level required. For example the wire may be held by two opposing strainers, and tensioning only one strainer is sufficient.

The tension of the wire may be maintained at a desired level, by the engagement portion. As discussed previously, different mechanisms for maintaining this tension are envisioned and should not be considered outside the scope of this invention. Such mechanisms are well known in the art.

Preferably, step c) involves applying a fastener to a threadable portion on the second end of the conductive device, against the housing which houses the tensioning device with the attachment point of the conductive link sandwiched between the fastener and housing.

Once the fastener is sufficiently tightened against the tensioning device, this may ensure contact of the conductive component to the wire, and also the conductive component to the conductive link. This has numerous advantages as previously discussed.

This method may be effectively used to connect numerous wires together to form an electric security system. Such a security system is advantageous over the prior art as may provide a system wherein the electric current passes through the strainers. If the wire is cut at any point along its length, this is intended to trigger notification of a security breach. This is different to the prior art as electric current conductive links are typically positioned at a distance from the strainer.

Below are some additional advantages of the current invention over the prior art.

- The invention makes it more difficult, if not impossible, for an intruder to breach the security fence by cutting a length of material without triggering an alarm
- It is a neat and attractive system as only one fixing is needed (not separate conductive link and strainer located at a distance) and the conductive links are always maintained in alignment.
- Likely to be cheaper for installation costs, as reduced labour and time involved in setting up system compared to other systems currently available.
- The conductive link may purposefully cover the insulative portion of the strainer so that if an intruder tries to touch or climb on the strainer, they are likely to get a shock. In contrast an installer or maintenance personnel can turn off the electric current before adjusting anything on the fence to avoid receiving a shock.
- A non-conductive tensioning device provides electrical isolation between the fence wires and the end fence posts.
- Allows use of conductive link to attach, lead out, feed, return to conductive component.
- Loosening of the fastener allows the ability to tension the wire without corresponding movement of conductive link. Wires can periodically slacken due to stretching. Therefore, it is easier to manipulate the strainer without having to remove or adjust the conductive links.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
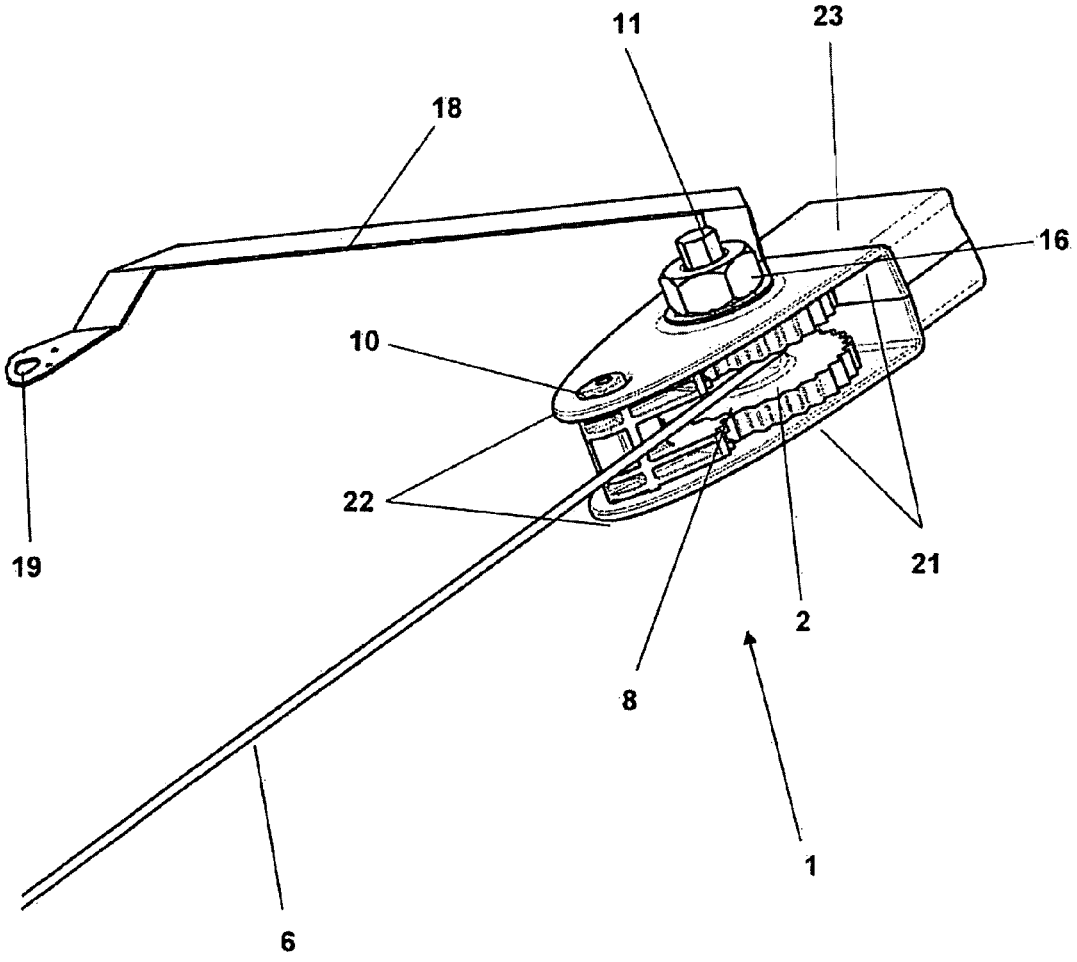
FIG. 1 shows the strainer according to one embodiment of the present invention.
Figure 8:
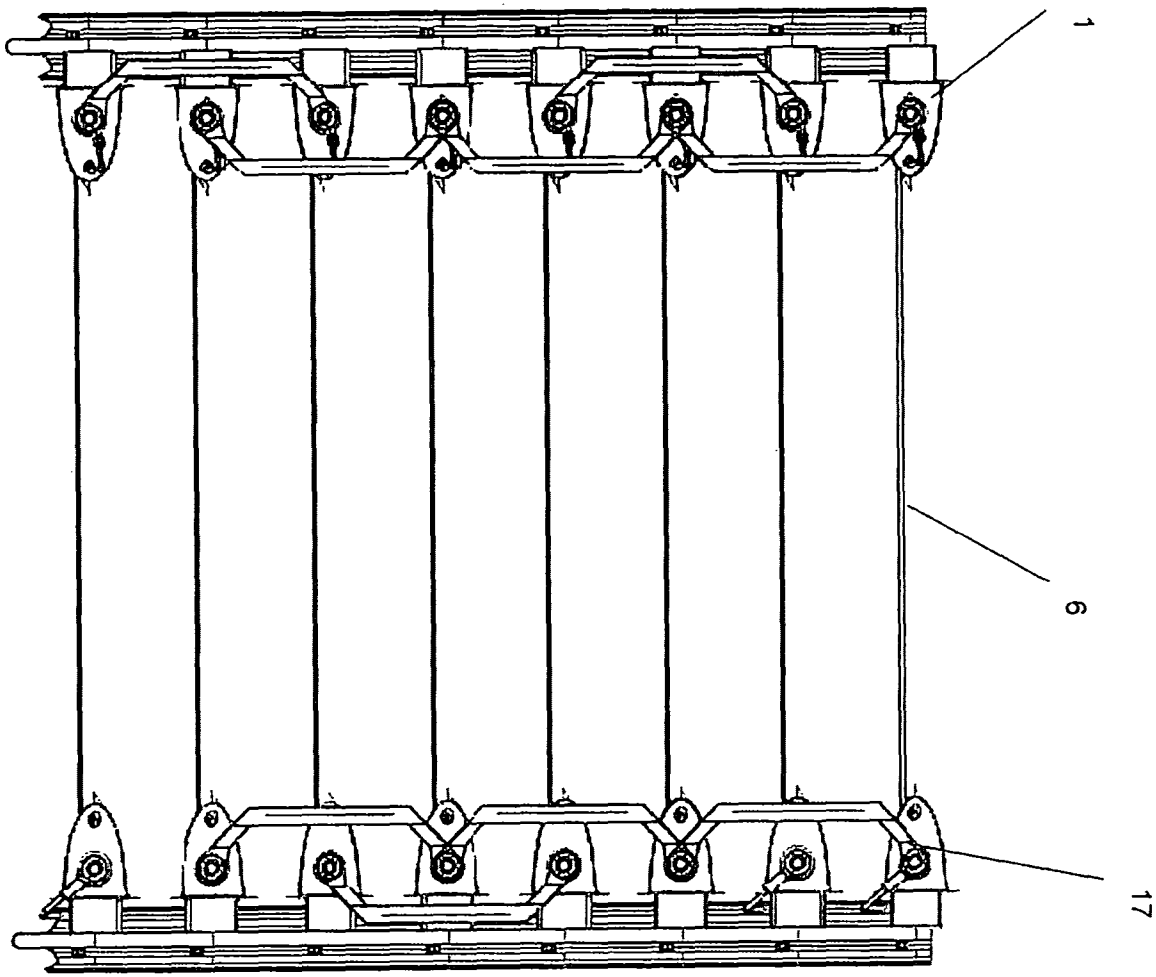
FIG. 8 shows a use of the strainer in an electric fence according to one embodiment of the present invention.

As shown generally in FIG. 1, the strainer (1) is in the form according to a particularly preferred embodiment of the present invention. The components of the strainer (1) are provided in FIG. 2 (exploded view). FIG. 8 shows a view of a multitude of strainers (1) mounted to posts (20) to form a security system.

Figure 2:
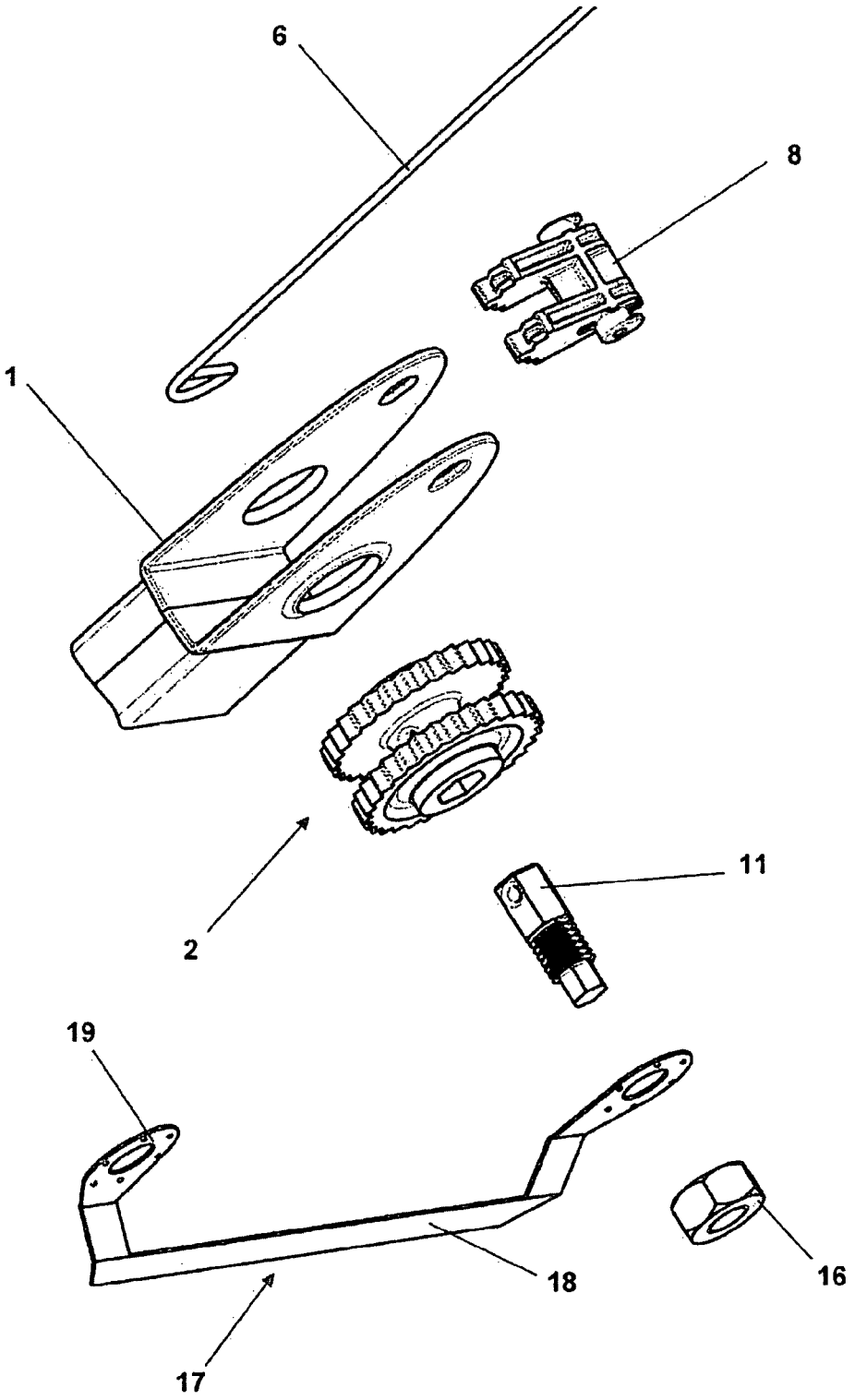
FIG. 2 shows an exploded view of the components of the strainer according to one embodiment of the present invention.

As shown in FIGS. 1 and 2, the strainer (1) is made substantially of plastic material except for the conductive component (11), the fastener (16), the conductive link (17) and the washer (25). The strainer (1) includes a housing with a head portion with rounded sides (21), rounded tips (22) and a box shaped backing portion (23).

As depicted generally in FIGS. 1 and 2, the strainer includes a tensioning device in the form of a ratchet (2).

Figure 4:
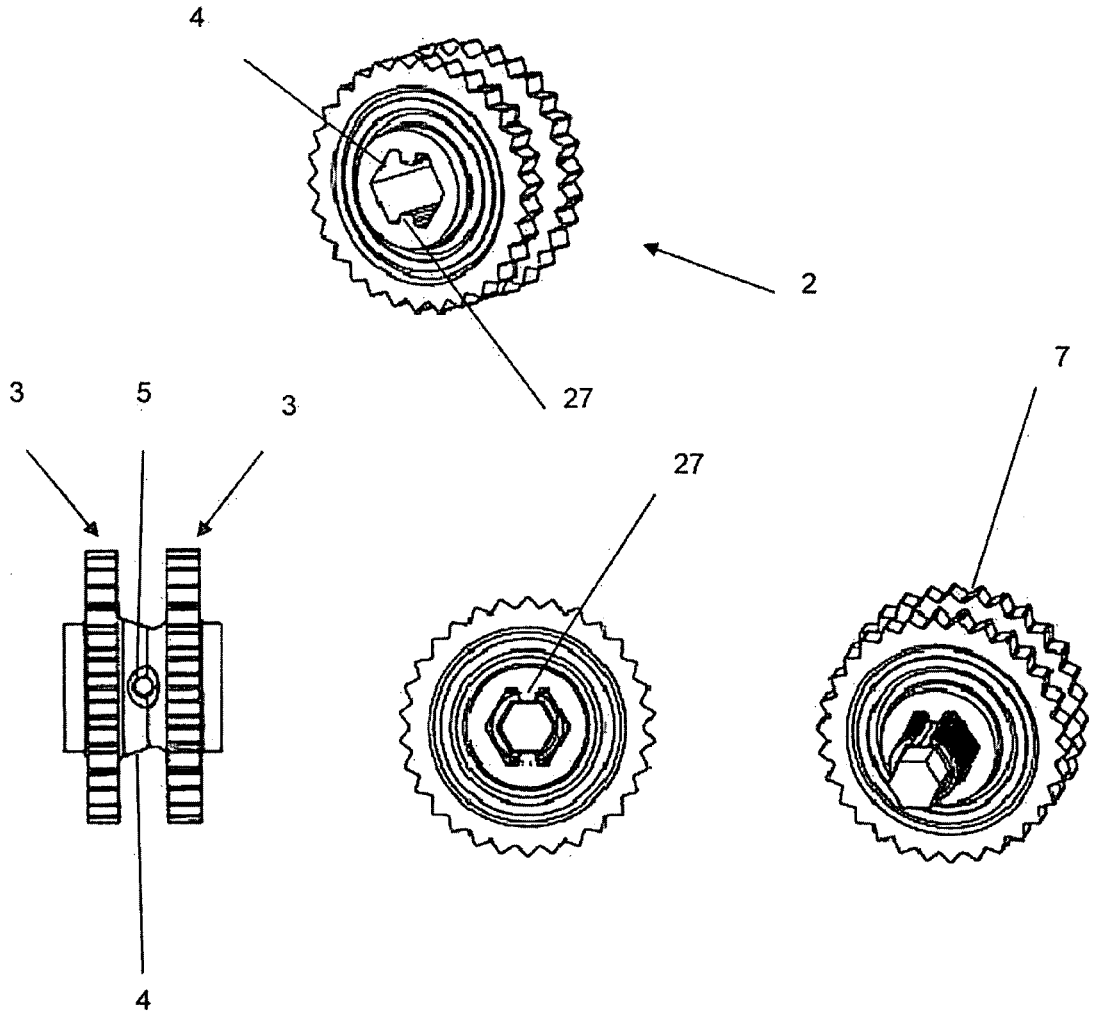
FIG. 4 shows different views of the tensioning device according to a second embodiment of the present invention.

As shown in FIG. 4, the ratchet has two "wheels" joined by a central portion (4). The ratchet (2) has an engagement portion configured as an aperture (5) which passes through the central portion (4) of the ratchet (2). As illustrated in FIG. 1, a length of material is provided as a wire (6), and is able to be positioned through the aperture (5). The central portion (4) is hollow with 6 sided walls. The hollow portion is accessible from both side of the ratchet (2).

The ratchet wheels (3) each have a set of symmetrically shaped triangular teeth (7) that project outwards from the circumference of the ratchet wheels (3).

The strainer (1) includes a locking mechanism configured as a pawl (8). This allows rotation of the ratchet (2) in one direction, but is able to prevent rotation of the ratchet (2) in the opposition direction. The locking ability of the pawl (8) is reversible such that locking in both directional movements is possible. This is achieved by rotating the pawl on its axle until the leading edge of the pawl (8) engages on the opposite side of the ratchet wheels (3). This may allow tensioning and locking of the wire (6) in either direction. The pawl (8) is positioned near the rounded tip (22) of the housing and is attached to the strainer (1) on a rotational axis point (10).

As shown in FIG. 4 the hollow portion (4) has two elongate protrusions (27) opposing each other which run approximately half the length of the hollow central portion peripheral to the aperture (5)

Figure 3:
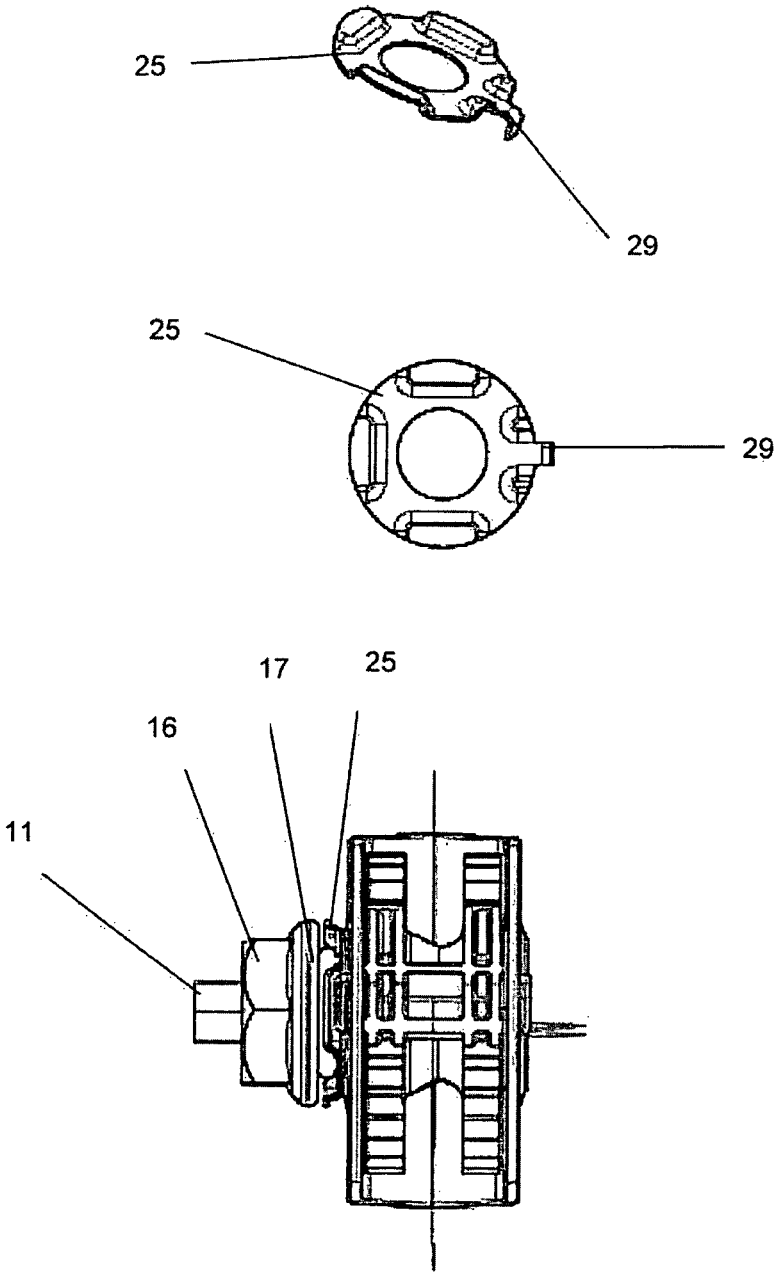
FIG. 3 shows a view of the strainer and the washer according to one embodiment of the present invention.

As shown in FIG. 3, the strainer preferably includes an optional washer (25) which is placed on the metal insert (11) adjacent to the housing. The washer (25) includes a protrusion (29) which is configured to engage with an aperture in the housing. The conductive link (17) if required, any wire link it retains and fastener (16) are then secured over the washer on the metal insert (11).

Figure 5:
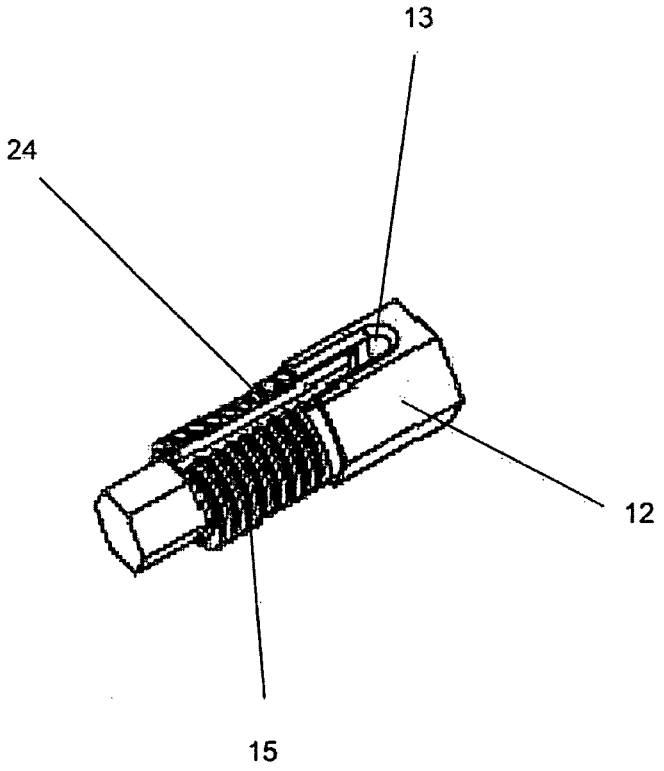
FIG. 5 shows a view of the conductive component according to one embodiment of the present invention.

As depicted in FIG. 5, the strainer (1) includes a conductive component in the form of a removable metal insert (11) that fits into the hollow central portion of the ratchet (2). The metal insert (11) is also displayed in FIGS. 1 and 2. The metal insert (11) has a first end configured as a six sided nut shaped head (12) with an aperture (13) passing through it.

As shown in FIG. 5, the six sided nut shaped head has two elongate recesses (24) which are configured to engage with the elongate protrusions (27) in the hollow central portion of the ratchet (2).

The aperture (13) is positioned such that when the metal insert (11) is positioned in the hollow central portion (4), it can align with the aperture (5) in the hollow central portion (4). The metal insert (11) has a thread (15) that is configured to interact with a fastener configured as a nut (16). The thread (15) is positioned on the metal insert (11) such that the thread (15) protrudes from the strainer (1).

Figure 6:
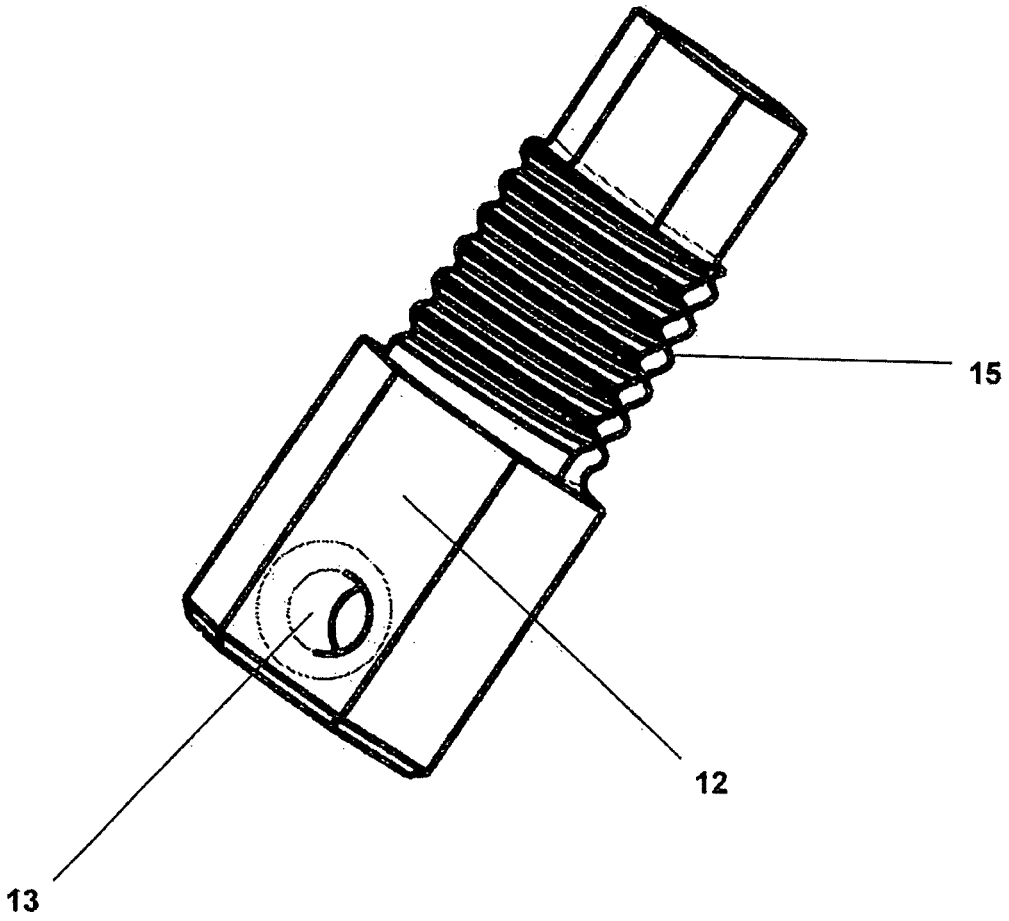
FIG. 6 shows a view of the conductive component according to a second embodiment of the present invention.
Figure 7:
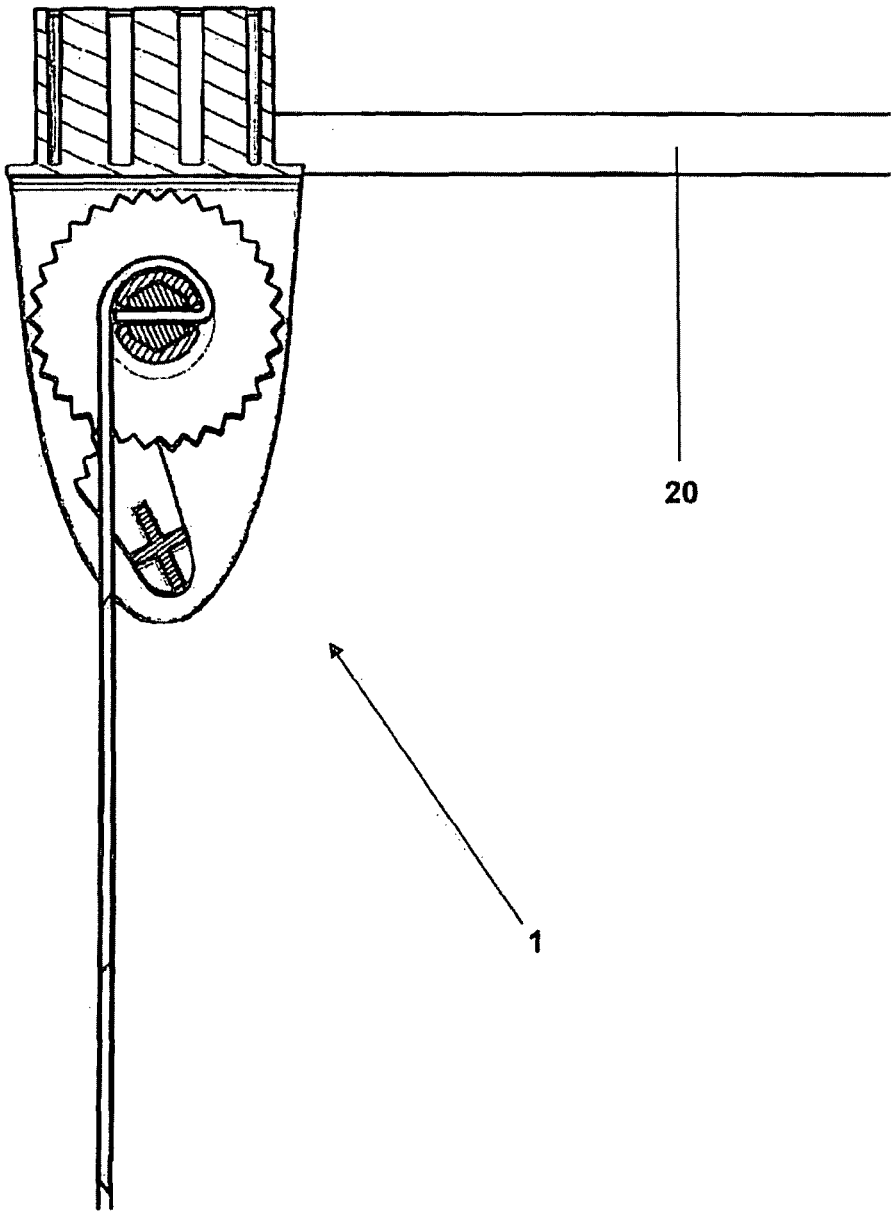
FIG. 7 shows a cross-sectional view of the strainer according to one embodiment of the present invention.

FIG. 6 shows an alternate configuration of the metal insert (11) without the elongate recesses (24).

As shown in FIGS. 1 and 2 the strainer includes a metal conductive link (17) in the form of an elongate central arm (18) with an offset attachment point (19) at either end. The linking points (19) are both out of the vertical and horizontal planes of the central arm (18). The linking points (19) are in the shape of washers with a raised annular protrusion on one side (not shown). An attachment point (19) of a conductive link (17) is configured to fit over a thread (15) of the metal insert (11) which protrudes from the strainer (1). Fastening a nut (16) on the thread (15) of the metal insert (11) can then also fasten the conductive link (17) to the strainer to link two strainers together.

The material used in all conductive elements in the present system is chosen to have the lowest galvanic corrosion potential when connected together. The wire (6) is made of alloy or high-tensile galvanised steel), the nut (16) and metal insert (11) are made of steel, (the nut is hot-dip or spun galvanised), and the conductive link (17) is made of either high-tensile galvanised wire, or punched and formed pre-galvanised metal).

The wires may normally be one of the following types: 2.0 mm to 2.5 mm solid alloy wire, 2.0 mm to 2.5 mm galvanised high-tensile steel wire, 1.6 mm solid alloy wire, 1.6 mm galvanised high-tensile steel wire, 2.7 mm composite wire (i.e. 2.5 mm high-tensile steel wire with a heavy alloy coating).

Alternatively all metal parts may be made from compatible stainless steel.

FIG. 8 shows one example of how the current invention can be used to configure an electric fence as a security system. The metal conductive link links two strainers positioned downstream or upstream and which are separated by a middle strainer. In the configuration shown in FIG. 8, the live wire is connected at the ends so that it zigzags in as a continuous conductive path. This is so an electric pulse may be sent into the wire at one end and monitored for a cut wire at the other end.

The conductive component is also used as a point of electrical contact for a lead out wire and anti-climb wires (not shown). The connections will be made preferably with a lug crimped on to the feed wire or with the feed wire attached directly to the conductive component via a fastener.

The earth wires are all connected together so that there are redundant connections. This helps to ensure there will be a shock between any adjacent wire and an earth wire. Other configurations are available, for example two continuous live wires.

Substantially any configuration may be achieved. Typically no more than two metal conductive links are connected to any strainer; however this is not essential.

Preferred configurations are:

Connecting every alternate wire for series circuits e.g. connecting first and third, second and fourth, fifth and seventh, sixth and eighth, etc.

Connecting every alternate wire for parallel circuits e.g. first, third, fifth, seventh, and so on, all connected together.

Connecting two adjacent wires e.g. connecting second and third wires.

Connecting two wires that are three wires apart e.g. connecting first and fourth wires.

Connecting wires that are more than three wires apart.

Aspects of the present invention have been described by way of example only and it should be appreciated that modifications and additions may be made thereto without departing from the scope of the appended claims.

What we claim is:

1. A strainer for straining a length of conductive material, the strainer including:

a non-conductive housing; and a tensioning device mounted in the housing configured to be actuated to tension the length of material between the strainer and an object, the tensioning device including:

an axle configured to rotate about its longitudinal axis relative to the housing, the axle including:

a hollow portion extending from at least one end of the axle along at least a portion of the longitudinal axis; and an aperture in a side of the axle into which the length of material may be inserted, wherein the aperture extends across the hollow portion;

an elongate insert configured to be received by the hollow portion of the axle, and move relative to the aperture along the longitudinal axis of the axle to contact and apply a force to the length of the material when inserted through the aperture, and wherein the elongate insert includes an attachment portion configured to extend through a portion of the housing and engage with a conductive link external to the housing.

2. A strainer as claimed in claim 1 wherein the elongate insert is configured to slidably fit within the hollowed portion of the axle.

3. A strainer as claimed in claim 1 wherein the elongate insert has at least one protrusion extending from a first end.

4. A strainer as claimed in claim 3 wherein the hollow portion of the axle includes a recess complementary to the protrusion of the elongate insert.

5. A strainer as claimed in claim 1 wherein the elongate insert includes a recess along a portion of its length.

6. A strainer as claimed in claim 5 wherein the hollow portion of the axle includes a protrusion complementary to the recess of the elongate insert.

7. A strainer as claimed in claim 1 wherein the attachment portion of the elongate insert has a fastener engagement portion configured to engage with a fastener.

8. A strainer as claimed in claim 7 wherein the fastener engagement portion of the attachment portion of the elongate insert has a threaded portion configured to engage with a corresponding nut.

9. A strainer as claimed in claim 1 including a locking mechanism configured to allow locking of the tensioning device in either a first or second direction.

10. A security system including at least one strainer as claimed in claim 1, wherein a length of conductive material is attached to the tensioning device of at least one strainer and in contact with the elongate insert in the strainer, wherein the strainer is also connected to an electric fence energizer via a length of material which is secured by the attachment portion of the elongate insert of the strainer.

11. A security system including:

at least two strainers, each having a non-conductive housing; and a tensioning device mounted in the housing and including an axle configured to rotate about its longitudinal axis relative to the housing, the axle including an engagement portion configured to engage a length of material and a hollow portion extending from at least one end of the axle along at least a portion of the longitudinal axis, wherein the tensioning device is configured to tension the length of material between the strainer and an object an elongate insert configured to be received by the hollow portion of the axle and contact the length of material at the engagement portion, wherein the elongate insert includes an attachment portion configured to extend through a portion of the housing, wherein at least one of the strainers is also connected to at least one other strainer of the security system via attachment of an external conductive link to the respective attachment portions of the elongate inserts of the respective strainers.

12. A security system as claimed in claim 11 wherein the conductive link is configured as an elongate arm with a linking point at both ends.

13. A security system as claimed in claim 12 wherein the linking points of the conductive link are configured to fit on the attachment point of the respective elongate inserts.

14. A method of constructing a security system as claimed in claim 11, the method including the steps of:

a) attaching a portion of a length of conductive material to the tensioning device of a first strainer wherein the length of material contacts a portion of the elongate insert on the first strainer;

b) attaching a different portion of the length of material to the tensioning device of a second strainer wherein the length of material is positioned to be able to contact a portion of the elongate insert on the second strainer;

c) attaching a conductive link from the first and/or second strainer to at least one additional strainer, wherein the conductive link is secured using the attachment portion of the elongate insert of the respective strainers;

d) applying an electrical current to the security system to allow electric current to travel between the strainers through the conductive links.

15. A method as claimed in claim 14 wherein the length of material is tensioned by an appropriate movement by the tensioning device.

16. A method as claimed in claim 14 wherein step c) includes applying a fastener to a threadable portion of the attachment portion of the elongate insert, ensuring the conductive link is positioned between the fastener and the housing.

* * * * *